United States Patent [19]

Foster et al.

[11] 4,217,323

[45] Aug. 12, 1980

[54] HEATING AND DRAWING OF SYNTHETIC FILAMENTS

[75] Inventors: Peter W. Foster; Thomas Berry, both of Tiverton, England; Karel Murenbeeld, Geneva, Switzerland

[73] Assignee: John Heathcoat & Company Limited, Tiverton, England

[21] Appl. No.: 872,076

[22] Filed: Jan. 25, 1978

[30] Foreign Application Priority Data

Jan. 27, 1977 [GB] United Kingdom ..... 3299/77

[51] Int. Cl.[2] ..... B29C 25/00; B29D 17/02

[52] U.S. Cl. ..... 264/235; 8/149.3; 8/151.2; 28/240; 28/246; 28/271; 264/288.4; 264/290.5; 264/346

[58] Field of Search ..... 264/290.5, 288.4, 235, 264/346; 28/246, 240, 271; 8/149.3, 151.2

[56] References Cited

U.S. PATENT DOCUMENTS

| | | | |
|---|---|---|---|
| 2,299,145 | 10/1942 | Hill et al. | 28/240 |
| 2,360,352 | 10/1944 | Lodge | 28/246 |
| 2,371,579 | 3/1945 | Cole et al. | 28/246 |
| 2,456,384 | 12/1948 | Conaway | 28/246 |
| 2,622,961 | 12/1952 | Finlayson et al. | 28/246 |
| 2,920,346 | 1/1960 | Jori | 28/246 |
| 3,423,809 | 1/1969 | Schmitt | 28/246 |
| 3,577,615 | 9/1971 | LeNoir | 28/271 |
| 3,583,048 | 6/1971 | Gutmann | 28/271 |
| 3,845,528 | 11/1974 | Vermeer et al. | 28/271 |
| 3,883,718 | 5/1975 | Ferment et al. | 28/246 |
| 4,059,668 | 11/1977 | Bittle et al. | 28/240 |
| 4,141,121 | 2/1979 | Trifunoric | 28/271 |
| 4,141,122 | 2/1979 | Trifunoric | 28/271 |

FOREIGN PATENT DOCUMENTS

| | | | |
|---|---|---|---|
| 2413718 | 10/1974 | Fed. Rep. of Germany | 28/271 |
| 1043445 | 11/1953 | France | 28/296 |
| 51-23614 | 7/1976 | Japan . | |

*Primary Examiner*—Jay H. Woo

*Attorney, Agent, or Firm*—Larson, Taylor and Hinds

[57] ABSTRACT

A method of providing a hot section in a continuously moving synthetic yarn comprises directing at least one jet of hot fluid obliquely across the moving yarn. The jet intersects the yarn at an obtuse angle to the approaching yarn. The method also produces drawn yarn by passing undrawn yarn into the jet and tensioning the yarn as it passes through the jet. Apparatus for performing the method includes a body member formed with a chamber formed with yarn entry and exit passages and a fluid ejecting nozzle. The body member may be additionally formed with a cavity opening from the chamber opposite the nozzle.

6 Claims, 3 Drawing Figures

HEATING AND DRAWING OF SYNTHETIC FILAMENTS

Figure 1:
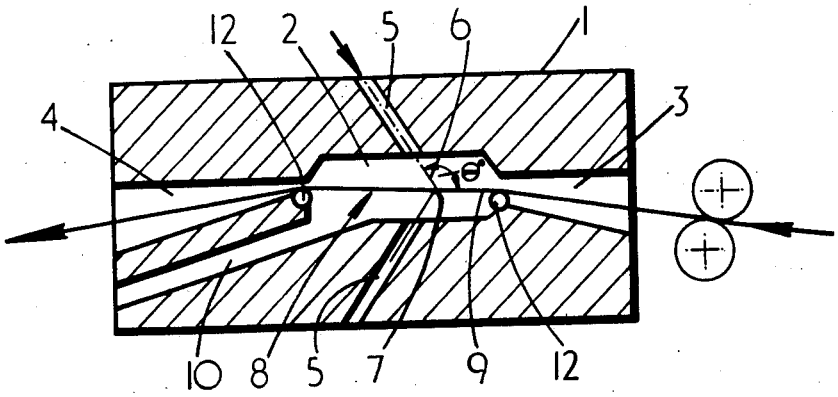

This invention relates to the heating and also the hot drawing of synthetic filaments.

When a synthetic filament issues from the spinneret forming it the chains of molecules of the filament are arranged in random fashion and the strength of the filament is comparatively low. To increase the strength it is necessary to reorientate the chains of molecules so that they all lie in substantially the same direction. This is done at present by a drawing operation in which any given length of filament is stretched to a length which is a multiple of its original length. To assist the drawing operation on the filament the filament is often heated, the amount of heating being dependent on the speed of drawing. As filaments are usually combined to produce a multifilament yarn it is customary to draw the filaments in the yarn form. The common method of drawing a multifilament yarn has been to pass the yarn between two sets of rollers the second set of which has a higher peripheral speed than the first set while heating the portion of the yarn between the rollers. An early method of heating yarn for drawing was to pass it over a hot plate. This method suffers from the disadvantage that since the heat is applied over a considerable length of the yarn it is difficult to control the position on the yarn at which stretching of the yarn takes place. An undesirable result of any indeterminateness and variation of the actual position where the yarn stretches during the drawing operation is that the dye take-up characteristics of the yarn vary throughout the length of the drawn yarn. Part of the trouble has been that the filaments of a multifilament yarn do not lie in a strictly side by side formation like a ribbon with the result that different filaments receive different amounts of heat or reach the desired temperature at different positions. In an early endeavour to locate with some accuracy the point of draw yarn has been drawn over a heated snubbing pin which did tend to localize the point at which drawing was initiated. A more recent method of heating was to apply the heat by means of hot rolls over which the yarn was passed.

These methods are fairly satisfactory where drawing speeds are low but at the greatly increased speeds at which synthetic multifilament yarns can now be spun and textured and particularly where it is desired to operate a combined spin-draw-texturing process difficulty has been experienced in introducing sufficient heat to the yarn in the time available as it passes over a snubbing pin or a hot plate or even a hot roll.

Attempts have been made to use a jet of hot gas, for example air or steam, to impart the desired amount of heat. The advantage of the gas jet is that the gas can permeate the yarn and heat all the filaments more or less simultaneously. Many proposals have been made for operating a gas heating process. These have all taken the form of passing the filament through a chamber located between two sets of rollers and introducing hot gas into the chamber. In an attempt to localize the heating zone some of the known constructions are arranged to direct jets of gas against the yarn at right angles to the yarn or obliquely, the orientation of the oblique jets being in the same general direction as that in which the yarn is travelling. According to another method yarn moving in one direction is immersed in a stream of hot gas moving in the opposite direction. These known methods and constructions have certainly enabled drawing speeds to be increased but not all the troubles associated with an indeterminate drawing zone in the yarn have been eliminated. Basically the problem is to transfer the necessary amount of heat to the moving yarn in such a way as to keep the length of the drawing zone constant and its position fixed in space, i.e. its position fixed with respect to a stationary datum position while a tension great enough to draw the yarn is generated in the yarn.

The problem described above exists both in the drawing of synthetic yarn and also in the process of heat treating of synthetic yarn where it is equally desirable to be able to heat continuously a specific length of yarn to a specific temperature for a specific time.

It is an object of the present invention to provide a method and an apparatus for effecting a transfer of heat to a continuously moving yarn in such a way as to provide in the yarn a hot section of length, temperature and position all of a constancy which is predetermined to an extent not hitherto achieved. The method and apparatus of the invention may thus be used to solve the stated problem. It is also an object of the invention to provide a method of and apparatus for heating and simultaneously drawing yarn which operate so as to solve the stated problems.

According to one aspect of the invention a method of providing a continuously moving yarn containing a section of maximum chosen temperature, of substantially constant length and of fixed position in space comprises directing at least one discrete jet of hot fluid obliquely across the moving yarn to intersect the yarn at an angle which, measured between the line of movement of the jet towards the point of intersection of the jet with the yarn and the portion of yarn approaching said point of intersection, is an obtuse angle.

Several such discrete jets of hot fluid may be directed obliquely towards the yarn from spaced angular positions around the yarn. The jets may be arranged to meet at a point through which the yarn passes.

According to another aspect of the invention a method of producing drawn yarn includes the step of guiding a moving length of yarn through at least one discrete jet of hot gas which is so directed at the yarn as to intersect the yarn at an angle which, measured between the line of movement of the jet towards the point of intersection of the jet with the yarn and the portion of yarn approaching said point of intersection, is an obtuse angle and simultaneously subjecting the yarn to a tensioning force.

According to yet another aspect of the invention a method of drawing yarn and of providing a drawn yarn comprises feeding yarn forwardly at one point at one speed, receiving the fed yarn at a second point spaced from the first point and feeding it forwardly from said second point at a higher speed and directing across the portion of the yarn spanning the two points at least one discrete jet of hot fluid, the jet being inclined with respect to the yarn so that it intersects the yarn at an angle which, measured between the line of movement of the jet towards the point of intersection of the jet with the yarn and the portion of yarn approaching said point of intersection, is an obtuse angle.

Several discrete jets of hot fluid may be directed obliquely at the yarn, the jets being angularly spaced around the yarn. The jets may be arranged to meet at a point through which the yarn passes.

The jets may be symmetrically or asymmetrically spaced around the yarn.

Also according to the invention apparatus for performing the method of providing a moving yarn containing a hot section of substantially constant length and temperature and of fixed position in space incorporates yarn feed means for feeding yarn continuously forward in a chosen path and at least one fluid ejecting nozzle located close to said yarn path downstream from said yarn feed means and so orientated that the line of discharge of the nozzle intersects the yarn path at a point of intersection and at an angle such that the portion of the line of discharge of the nozzle between the nozzle and said point of intersection makes an obtuse angle with the portion of the yarn path between the yarn feed means and said point of intersection.

The apparatus may incorporate a body member formed with an internal chamber and aligned yarn passages at opposite ends of the chamber extending between the exterior of the body member and the chamber for entry and exit of yarn respectively and at least one nozzle debouching obliquely into the chamber, the nozzle being so orientated that its line of discharge intersects the common centre line of the aligned yarn passages at a point of intersection and at an angle such that the portion of the line of discharge of the nozzle between the nozzle and said point of intersection makes an obtuse angle with the portion of said common centre line which lies between said point of intersection and the yarn passage intended for entry of yarn to the chamber.

The nozzle may be located anywhere between the yarn entry passage and the yarn exit passage.

The body member may incorporate several obliquely orientated nozzles debouching into the chamber, the nozzles being spaced angularly around the common centre line of the yarn passages.

The body member may also be formed with at least one exhaust passage leading out of the chamber.

The body member may additionally be formed with a blind cavity penetrating the wall of the chamber, the cavity being so located that the line of discharge of the nozzle enters the cavity. Where the body member incorporates several nozzles it may be formed with several blind cavities one for each nozzle and each so located that the line of discharge of each nozzle enters a respective cavity.

Apparatus for performing the method of drawing yarn and of producing drawn yarn according to the invention incorporates two spaced successive sets of rollers defining a yarn path between them, means for rotating the succeeding set of rollers at a peripheral speed greater than that of the preceding set of rollers, and at least one nozzle located adjacent the yarn path and so orientated that the line of discharge of the nozzle intersects the yarn path at a point of intersection and at an angle such that the portion of the line of discharge of the nozzle between the nozzle and said point of intersection makes an obtuse angle with the portion of the yarn path lying between said point of intersection and the preceding set of rollers.

The apparatus may incorporate several such nozzles spaced angularly around the yarn path. The nozzles may be so located that the lines of discharge of the nozzles intersect one another at the same point on the yarn path.

In one construction which gives very good results the nozzle is located adjacent the yarn entry passage, the exhaust passage is located adjacent the yarn exit passage and a blind cavity is so located in the wall of the chamber that the line of discharge of the nozzle enters the cavity.

Figure 2:
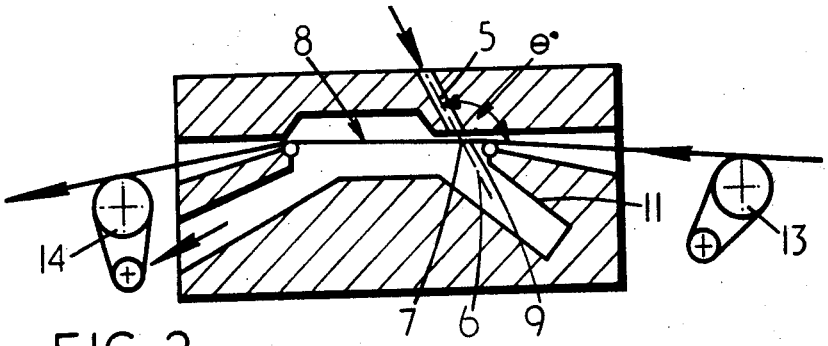
Figure 3:
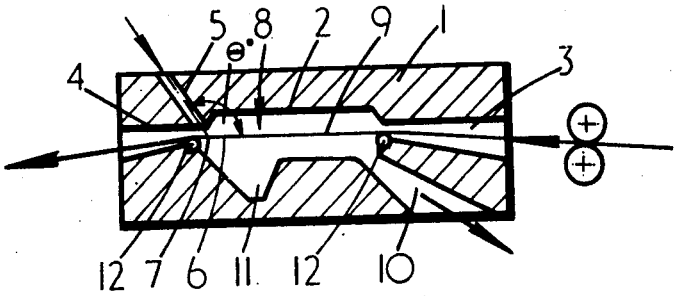

Practical embodiments of the invention are illustrated in the accompanying drawings in which FIGS. 1, 2 and 3 show alternative arrangements of the apparatus for heating yarn passing therethrough at a specific point. FIG. 2 shows the apparatus arranged as a yarn drawing device.

In the drawings 1 denotes a body member formed with an internal chamber 2 and aligned yarn passages 3 and 4 provided at oppposite ends of the chamber for entry and exit of yarn respectively. 5 denotes a nozzle directed obliquely into the chamber, the nozzle being so orientated that its line of discharge 6 intersects at an intersection point 7 the yarn path, i.e. line of movement 8 of yarn passing through the chamber 2. The portion of the line of discharge 6 of the nozzle 5 between the nozzle 5 and the point of intersection 7 makes an angle $\theta$ with the portion 9 of the yarn path 8 which lies between the point of intersection 7 and the yarn passage 3 and said angle $\theta$ is an obtuse angle. 10 denotes an exhaust passage for discharge of fluid from the chamber 2. In the construction of FIG. 2 the chamber wall is formed with a cavity 11 opposite the nozzle 5, the cavity being so directed that the line of discharge 6 of the nozzle continued beyond the intersection point 7 enters the cavity 11. In the construction of FIG. 1 the nozzle 5 is located approximately midway between the ends of the chamber 2. In the construction of FIG. 2 the nozzle 5 is located close to the entry end of the chamber i.e. close to the yarn entry passage 3. In the construction of FIG. 3 the nozzle 5 is located close to the exit end of the chamber 2 i.e. close to the yarn exit passage 4 while the exhaust passage 10 is located nearer the entry end of the chamber 2.

In all the constructions illustrated 12 denotes pins at the points where the passages 3 and 4 debouch into the chamber 2, these pins being of assistance in locating the exact position of the yarn path 8 in the chamber 2 so that the discharge line of the nozzle 5 will intersect accurately yarn passing through the chamber 2.

In the construction of FIG. 2, 13 and 14 denote rollers for tensioning the yarn on its passage through the chamber 2 so that a drawing action may be performed. The rollers 14 are arranged to rotate at a higher peripheral speed than the rollers 13.

In practice, yarn is fed from the entry passage 3 through the chamber 2 and out through the exit passage 4 while hot fluid enters the chamber through the nozzle 5 and is discharged from the nozzle 5 as a discrete jet which intersects the yarn at the intersection point 7. At this intersection point the temperature of the yarn is highest because it is meeting the fluid immediately on issue of the fluid from the nozzle 5. Because the fluid merely intersects the yarn this high temperature heating zone extends along the yarn a distance little greater than the width of the jet because when the jet crosses the yarn it continues its onward movement beyond the yarn. On passing beyond the yarn the jet ultimately expands into the chamber 2 and as the angle $\theta$ is an obtuse angle some of the expanded and consequently cooled fluid moves some distance counter to the direction of movement of the yarn and this preheats the yarn without plasticizing it before the fluid makes its way to the outlet passage 10. The concentration of heat at a specific point on the yarn is even greater in the constructions of FIGS. 2 and 3 because the presence of the cavity 11 opposite the nozzle permits the jet of fluid issuing from the nozzle 5 to pass well beyond the yarn without turbulence occurring in the vicinity of the yarn which would have the effect of extending the length of the high temperature heating zone. The construction of FIG. 3 provides for the highest degree of preheat of the yarn and is thus of most use where very high yarn speeds are to be operated. While all the constructions illustrated give good results the constructions of FIGS. 2 and 3 give particularly good results.

As has been already stated it is known to pass yarn through a stream of hot gas moving in the opposite direction from the yarn with the object of heating the yarn. In the known construction, however, the hot gas is not introduced to the yarn as a discrete jet intersecting the yarn. It is introduced through an annular port surrounding the yarn and merely provides a thick sleeve of fluid through which the yarn passes. There is thus only a small temperature gradient along the yarn and the point where the yarn is to attain a desired temperature e.g. a plasticizing temperature, is indeterminate. For ideal conditions of high speed drawing it is essential that the yarn should be suddenly raised above its plasticizing temperature over a very short length and on both sides of this short length it should be below its plasticizing temperature so that drawing takes place over this short length only. At high speeds i.e. speeds upwards of 4000 m/minute the time taken for the yarn to travel the short distance over which it is desirable that drawing should take place is extremely small and in fact is measured in thousands of a second and by the known methods and apparatus even using the known counterflow method and apparatus it is very difficult if not impossible to impart enough heat to plasticize the yarn while maintaining the plasticized portion short enough and accurately enough located in position to provide a constant degree of dye acceptance. What is required to be done to obtain the ideal conditions is to preheat the yarn until it is at a temperature just below the plasticizing temperature and then subject the yarn to a concentrated inflow of heat over the short distance where the yarn is to be plasticized. The applicant's method and apparatus provide exactly these conditions in that the yarn entering the chamber first of all meets expanded and comparatively cool fluid where it is preheated and its temperature continues rising until it reaches the point of intersection of the jet with the yarn. At this point it abruptly meets the unexpanded fluid at its highest temperature so that maximum heat inflow to the yarn takes place over this short distance where the jet intersects the yarn. Immediately it leaves the intersection point it again enters a zone of expanded and comparatively cool fluid and the yarn being now at a higher temperature than the fluid it immediately cools to below the plasticizing temperature. By adjustment of the quantity and temperature of the hot fluid entering the chamber the conditions can be readily set to provide for a non-plasticizing temperature on each side of the intersection point of the jet with the yarn and a plasticizing temperature in the yarn at the intersecting point.

It will be understood that the method and apparatus for heating yarn described in this specification can be applied to the heating of yarn for purposes other than drawing, for example in subjecting yarn to pure thermal treatment to alter properties other than yarn modulus. Such other thermal treatment may be the treatment of overage yarn which is the subject of a co-pending patent application by the same applicants.

What is claimed is:

1. A method of providing a continuously moving synthetic yarn containing a section of maximum temperature, of substantially constant length and of fixed position in space comprising moving the yarn through an enclosed space between two yarn guides located at opposite ends of the enclosed space and arranged to guide the yarn through the space with substantially no transverse deviation so that the yarn follows a rigidly defined path and heating the portion of yarn between the guides by hot gas in two stages with an abrupt change from one stage to the other, the two stage heating being effected by concentrating the hot gas into at least one discrete high velocity jet a portion of which extends from the point of jet formation and while unconfined by boundary surfaces has a clearly defined rod-like shape, bringing the rod-like portion of the jet into abrupt contact with the yarn at a specific and unchanging position on the yarn and at an angle which, measured between the line of movement of the jet towards the point of intersection of the jet with the yarn and the portion of the yarn approaching said point of intersection is an obtuse angle, permitting the gas forming the jet to expand after it has met the yarn until it loses its rod-like shape then bringing the expanded gas back into contact with the approaching unheated yarn upstream from the meeting point of the unexpanded jet and the yarn.

2. A method as claimed in claim 1 comprising directing several discrete jets of hot gas obliquely towards the yarn, the jets being angularly spaced around the yarn.

3. A method as claimed in claim 2, in which the jets are arranged to meet at a point through which the yarn passes.

4. A method of producing drawn synthetic yarn comprising moving undrawn yarn continuously forward through an enclosed space between two yarn guides located at opposite ends of the enclosed space and arranged to guide the yarn through the space with substantially no transverse deviation so that the yarn follows a rigidly defined path, heating the portion of yarn between the guides by hot gas in two stages with an abrupt change from one stage to the other and simultaneously subjecting the yarn to a tensioning force, the two stage heating being effected by concentrating the hot gas into at least one discrete high velocity jet a portion of which extending from the point of jet formation and while unconfined by boundary surfaces has a clearly defined rod-like shape, bringing the jet while in its rod-like shape into abrupt contact with the yarn at a specific and unchanging position on the yarn and at an angle which, measured between the line of movement of the jet towards the point of intersection of the jet with the yarn and the portion of the yarn approaching said point of intersection is an obtuse angle, permitting the gas forming the jet to expand after it has met the yarn until it loses its rod-like shape then bringing the expanded gas back into contact with the approaching unheated yarn upstream from the meeting point of the unexpanded jet and the yarn.

5. A method as claimed in claim 4 comprising directing several discrete jets of hot gas obliquely towards the yarn, the jets being angularly spaced around the yarn.

6. A method as claimed in claim 5 in which the jets are arranged to meet at a point through which the yarn passes.

* * * * *